United States Patent [19]

Kalbow

[11] 4,111,666

[45] Sep. 5, 1978

[54] METHOD OF MAKING CLEANING, SCOURING AND/OR POLISHING PADS AND THE IMPROVED PAD PRODUCED THEREBY

[75] Inventor: Heinz Kalbow, Konigswinter-Stieldorf, Fed. Rep. of Germany

[73] Assignee: Collo GmbH, Bornheim-Hersel, Fed. Rep. of Germany

[21] Appl. No.: 702,391

[22] Filed: Jul. 6, 1976

Related U.S. Application Data

[63] Continuation-in-part of Ser. No. 662,349, Mar. 1, 1976, Pat. No. 4,055,029.

[30] Foreign Application Priority Data

Mar. 7, 1975 [DE] Fed. Rep. of Germany ... 7507155[U]
Feb. 12, 1976 [DE] Fed. Rep. of Germany ..... 2605444

[51] Int. Cl.[2] ..... B24D 3/32; B24D 15/04

[52] U.S. Cl. ..... 51/295; 51/298 R; 51/395

[58] Field of Search ..... 51/295, 298, 296, 395, 51/401

[56] References Cited

U.S. PATENT DOCUMENTS

| | | | |
|---|---|---|---|
| 2,001,911 | 5/1935 | Wooddell et al. | 51/295 |
| 2,907,146 | 10/1959 | Dyar | 51/397 |
| 3,073,716 | 1/1963 | Gilchrist | 51/295 |
| 3,124,822 | 3/1964 | Marchese | 51/295 |
| 3,182,346 | 5/1965 | Winston | 51/295 |
| 3,188,675 | 6/1965 | Beck | 51/397 |
| 3,252,775 | 5/1966 | Guilbert | 51/298 |
| 3,498,010 | 3/1970 | Hagihara | 51/295 |
| 3,529,945 | 9/1970 | Charvat | 51/296 |
| 3,605,349 | 9/1971 | Anthon | 51/295 |
| 3,609,925 | 10/1971 | Riera | 51/402 |

*Primary Examiner*—Donald J. Arnold
*Attorney, Agent, or Firm*—Meyer, Tilberry & Body

[57] ABSTRACT

In a cleaning, scouring, scrubbing and/or polishing pad of the type formed from a pliable, flexible foam plastic body having a scrubbing surface with a plurality of protuberances being defined by peripheral surfaces generally perpendicular to and forming generally sharp edges with an upper scrubbing surface of the protuberances, there is provided an improvement which includes a hardened flexible, elastic material, generally more rigid than the foamed plastic material forming the pad, and impregnated into the foamed plastic at the protuberances to a depth of at least the height of the protuberances.

8 Claims, 2 Drawing Figures

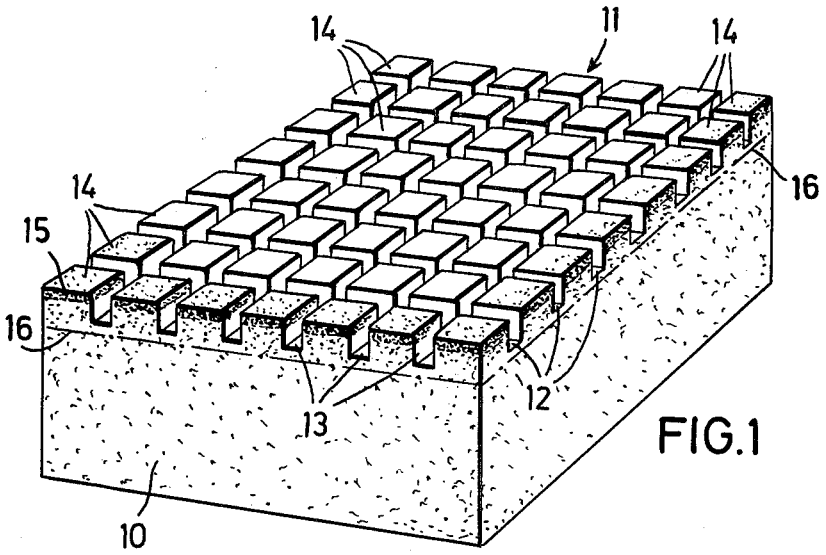
FIG.1
FIG.2
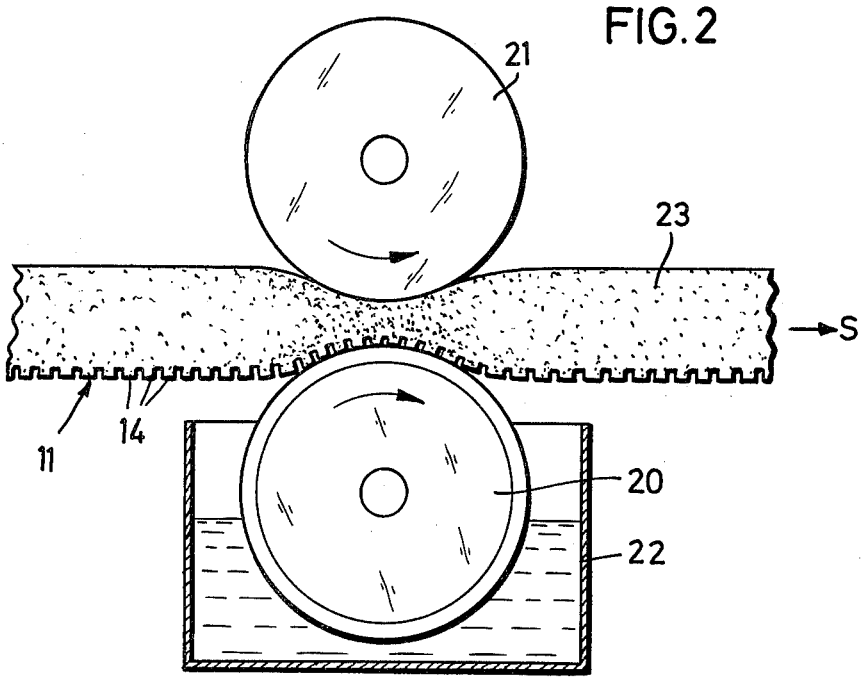

METHOD OF MAKING CLEANING, SCOURING AND/OR POLISHING PADS AND THE IMPROVED PAD PRODUCED THEREBY

This application is a continuation-in-part application of prior U.S. application Ser. No. 662,349, filed Mar. 1, 1976 now Pat. No. 4,055,029, and incorporated by reference herein.

In this prior application, there is described a new invention which includes the provision of protuberances or bosses having sharp edges and arranged on the contoured working or scrubbing surface of a foamed plastic pad or element of the type used in cleaning, scouring and/or polishing. In accordance with the preferred embodiment of the invention disclosed in the prior application, the bosses or protuberances have a polygonal contour, shape or form, more particularly a rectangular or square form. The bosses or protuberances are formed from open-cell foam material of the type used for foam plastic cleaning pads. By providing a plurality of bosses or protuberances with sharp contours or peripheral edges distributed over the working surface of the pad, the protuberances, as a result of deformation occurring in use of the pliable and flexible foam plastic element and the unique position of the bosses or protuberances which result therefrom, develop a particularly pronounced and effective scouring or rubbing action on the surface to be cleaned, scoured, or polished by the pad. As a result of this improved action, considerably better cleaning or scouring can be accomplished. The arrangement of the bosses or protuberances and the shaping thereof as disclosed in the prior application permits an effective treatment of extremely uneven surfaces. Parts of the surface to be cleaned, scoured or polished and to which access is difficult can be reached with the improved pad, as described in the prior application, and including the plurality of bosses or protuberances at the scouring or scrubbing surface.

In accordance with a disclosed aspect of the invention, as described in the prior application, a coating is provided on the upper surfaces of the protuberances and, especially in the region of the contoured edges. This material or coating is preferably a fine-grain grinding or scouring agent, or the like, applied by an adhesive to the upper surfaces or edges of the protuberances. The adhesive is flexible when hardened, thus, after the adhesive has hardened, the fine-grain grinding or scouring agent in the adhesive is bonded to the upper surfaces or scrubbing surfaces of each of the individual bosses or protuberances. The abrasive material disclosed in the prior application is a rigid foam plastic material in granular form, which can be obtained by comminuting a foam plastic element which is compounded to be somewhat rigid, such as polyurethane foam. This abrasive, powdered or particulated material is more rigid than the pliable foam forming the body of the pad. Such a fine-grain rigid foam material is generally softer or more pliable than the surface to be scoured, but has, at the points of the rupture of the cell walls, sharp cell wall edges which develop a pronounced scrapping effect on being triturated on the surface to be cleaned, scrubbed, scoured or polished. On the other hand, the fine-grain foam plastic material with the thin cell walls is so brittle that the sharp edges break off after encountering a relatively strong bearing pressure. This adds to the polishing effect of the pad. By using an abrasive material as described in the prior application, it is possible for even sensitive surfaces, such as metal surfaces, lacquer or synthetic plastic surfaces to be rubbed thoroughly, but at the same time gently, without any undesired scratching of the surfaces undergoing the scouring or rubbing. This rigid foam plastic material which is preferably used in accordance with the invention of the prior application has a grain size in the range of 50–500 $\mu$, and more specifically in the range of 100–200 $\mu$.

In the prior application, the height of each of the protuberances from the rest or main portion of the pad body has a dimension that is considerably smaller than the length of the edges on the protuberances. The depth and breadth of the grooves between the protuberances, which grooves are primarily rectangular, are so chosen that they are always considerably smaller than the edge dimensions of the protuberances. As described in the prior application, it is recommended that the grooves forming the protuberances should be of such depth dimension that the depth is at least equal to the breadth of the groove. It is preferred that the depth be larger than the breadth of the grooves. Generally, the breadth of the grooves will be about 2 to 5 mm. Preferably, the depth is 2 to 3 mm. In addition, the depth is about 1.5 to 3 times larger than the breadth dimension of the grooves. With square protuberances, the length of the edges is preferably about 3 to 8 times the breadth or width of the grooves. More precisely, the depth is in the range of 4 to 6 times the breadth of the grooves.

In accordance with the prior application, the pad is an integral unit formed from polyurethane foam which is compounded to be flexible and pliable. Other synthetic foamed plastics could be used for this purpose. In the illustrated embodiment, the foam plastic pad has the form of a square such as used in domestic sponges. The grooves are illustrated as intersecting each other at approximately 90° in the preferred embodiment to produce rectangular or square bosses or protuberances on the scrubbing surface of the improved pads of the invention disclosed in the prior application. The adhesive used for securing the abrasive material or the finely comminuted rigid foam plastic material is disclosed as being preferably a synthetic plastic adhesive, such as polyurethane two-component adhesive with a solvent and a solid content in the range of about 20%. Such an adhesive, which is commerciallay available, has a certain flexibility, even after curing, which is advantageous for the purpose to which the foam plastic element is adapted. Up to 50% by weight, preferably about 20–30% by weight, of abrasive material is added to the adhesive. Thereafter, the viscous liquid mass is applied to the upper surfaces of the protuberances to provide the upper adhesive surfaces in the illustrated embodiment of the prior application.

The present invention relates to an improvement in the scouring, cleaning, scrubbing and/or polishing pad described in the above-identified prior application. In the prior application a foam material body for cleansing, scrubbing and/or polishing purposes formed from a flexible foam material has, on its profiled working or scrubbing surface, a large number of sharp-edged upstanding protuberances or projections. Generally, these protuberances have a rectangular or square outer contour and have, on their upper surface a coating of adhesive and a scouring or abrasive material or particles.

Such foam items are used as cleansing and scouring sponges or pads, particularly for housekeeping purposes or for keeping automobiles clean. The protuberances of the prior application are closely spaced and distributed over the scrubbing surface of the foam body or pad. The protuberances have sharp contour edges. With the deformation of the soft, flexible foam body which occurs during use, the resulting oblique positioning of the protuberances and their edges produce a particularly pronounced and efficient scouring and scraping effect. This increases the cleansing and scouring efficiency of the pad. The coating of the upper surfaces of the protuberances with abrasive material is obtained by applying to these surfaces a fine-grained abrasive material carried by an adhesive in such a manner that after the hardening of the adhesive the abrasive material, more or less bound in the adhesive, adheres firmly on the upper surfaces of the protuberances. The abrasive material is a granular or particulate rigid foam material which can be produced by fragmentation of rigid foam bodies, particularly those made of polyurethane foam. Such a fine-grained rigid foam material is usually softer than the surface to be scoured, but has, at the breaking or fracture points of the cell walls, sharp cell edges which produce a gentle scraping effect. It is, therefore, possible to work with such an abrasive material even on delicate surfaces, such as metal surfaces, lacquer or plastic surfaces, without risking undesirable scratching of the surfaces being rubbed.

The application of the abrasive material on the protuberances of the foam material body or pad is accomplished by use of an adhesive which, like particularly a polyurethane two components adhesive, is flexible even after it hardens or cures.

Because of the extensive dividing of the scrubbing surface of the foam body or pad to provide several projections or protuberances, the tensile strength of the foam body or pad at the scrubbing surface is reduced. The danger, thus, exists that, particularly in the case of a hard scrubbing action, the protuberances may tear away from the main body of the pad. This could be avoided by using a highly tear-resistant foam material. Such highly tear-resistant foam materials are, however, expensive and generally have fine-pored foam structure. Consequently, a stronger foam material would have a relatively poor moisture absorption capacity and would not be satisfactory for a multi-purpose household pad. It is the object of the present invention to improve the foam material bodies or pads according to the prior application in such a way that the tensile strength at the scrubbing surface is considerably increased while still using standard inexpensive foam materials having no exceptionally high tensile strength. By using the present invention inadvertent tearing of the projections or protuberances at the scrubbing surface is drastically reduced, if not fully eliminated.

In accordance with the present invention, the foam material body or pad is impregnated on its working or scrubbing or scouring surface with a hardening impregnating agent for increasing the resistance of the protuberances to tearing. The agent extends down to a depth which reaches at least to the root of the protuberances and preferably even somewhat deeper into the main body portion of the pad.

By reason of this impregnation of the foam material body, the pad is considerably reinforced in its tear resistance on its profiled working surface which is reduced in strength by the great number of protuberances. This impregnation and reinforcement is accomplished without destroying the overall flexibility of the foam material body and its absorptive capacity. The increase of the tensile strength of the foam material body offers the possibility of using considerably less expensive foam material bodies of a moderate tensile strength without the danger of the projections or protuberances being torn in or off in normal use of the pad. By the impregnating agent penetrating through the projections or protuberances extending into an area below their roots, a considerable reinforcement of the anchoring of projections onto the foam material of the main body portion is accomplished at a relatively low cost.

The method, according to the invention, is appropriately performed in such a way that first the penetration of the foam material body by the impregnating agent is brought about. After at least partial hardening of the impregnating agent the coating with the abrasive material takes place in a subsequent operation. The impregnating agent is the adhesive used to secure the abrasive onto the protuberance. Particularly advantageous is a procedure in which the flexible foam material body is compressed during the application of the liquid impregnating agent. Subsequently the pressure is released and the pad elastically restores itself. During this restoring action, of the deformed foam material body, the previously applied impregnating agent is sucked inwards from the working or scrubbing surface or the upper surfaces of the projections or protuberance respectively. In this manner, the liquid impregnating agent or adhesive penetrates through the projections or protuberances down to the area of their roots. Preferably, the agent progresses down to a depth of a few millimeters below the roots of the protrusions. This method makes a simple and procedurally inexpensive impregnation of the foam material body possible. The application of the impregnating agent and the compression of the foam material body can in this procedure be carried out by means of a coating roller or the like.

According to a second aspect of the present invention the foam material body consisting of a strip, a sheet or a panel is cut into individual pad or pillow-shaped pieces of the desired form and size, after the impregnation and preferably also after the application of the abrasive coating. This operational procedure is particularly advantageous, since it saves the foam material body, or its working surface, from warping or buckling during the hardening of the impregnating agent.

As an impregnating agent it is preferable to use an adhesive, which is elastic in its hardened condition, particularly a plastic adhesive, like a polyurethane two-components adhesive. It is advisable to use, for the impregnation and the subsequent coating of the protuberances with the abrasive material, the same adhesive. In this procedure, the adhesive used for the impregnation, of course, includes no abrasive material or the like. Particularly suitable as an adhesive for the aforementioned purposes is one based on polyol, polyol-polyurethane-isocyanate, a plasticizer, like benzyl-butylphthalate, and solvents, like ethyl-acetate and acetone.

The invention is explained in connection with the illustrative examples shown in the accompanying drawings, in which:

FIG. 1 is a perspective view of a foam material body according to the invention which can be used as a sponge for housekeeping chores like cleansing and scrubbing; and FIG. 2 is a schematic view of an apparatus for practicing the preferred embodiment of the invention.

The foam material sponge or pad, shown in FIG. 1 includes a flexible, open-celled foam material body 10, particularly of polyurethane foam, although other synthetic foam materials can also be used for this purpose. The profiled working surface 11 of the foam material body 10 includes a large number of parallel, intersecting grooves 12 and 13. The grooves 12 cross the grooves 13 at an angle of 90°. Consequently, on the working surface 11 of the foam material body 10 there are provided a number of closely spaced rectangular or square-shaped projections or protuberances 14, each generally enclosed by the grooves whose height is equal to the depth of the grooves. The grooves have a depth and width which is considerably smaller than the edge dimension of protuberances 14. The width of the grooves 12 and 13 amounts generally to about 2 to 5 mm, preferably 2 to 3 mm, whereas their depth is about 1.5 to 3 times larger than the horizontal dimension. The edge dimension of the protuberance 14 is about 3 to 8 times, preferably four to sixfold times, larger than the width of grooves 12 and 13.

Grooves 12 and 13 can be worked into the surface of the foam material body 10 with the aid of parallel milling tools. However, it is also possible to use, for profiling the working surface 11, a hot forming die which removes, by heating and fusing, respectively, the foam material in those places in which the grooves 12 and 13 are worked to be provided.

In order to increase the tear resistance of the foam material body on its profiled working surface 11, the foam material body is impregnated on its working surface 11 with an impregnating agent. This is preferably done, according to FIG. 2, by means of a pair of rollers 20 and 21. Lower roller 20 forms the application roller for the impregnating agent or liquid. This roller rotates in a container 22 that receives this roller. In the impregnation of the foam material body 23 consisting of a relatively large foam material strip or a foam material sheet, rollers 20 and 21 turn in the direction of rotation indicated by arrows and sheet moves in the direction of arrow S. The foam material strip or sheet passes through the gap or nip between rollers 20 and 21. The roller nip is substantially smaller than the thickness of the foam material sheet 23. Consequently, the sheet is compressed while passing between the rollers. The application roller 20 turns through the liquid impregnating agent contained in the tank 22 and covers with it the lower working surface 11 of the foam material sheet 23. This working surface is profiled as shown in FIG. 1. It is recognizable that the foam material sheet 23 is, after passing through the roller gap, again restored to its original non-compressed shape. The liquid impregnating agent applied to the working surface 11 is, in this expansion or restoration operation, sucked into the open-pores or cells of the foam material. Thus, the liquid penetrates into the projections or protuberances 14 down to the area of their roots. The working surface of the foam material body 23 is, by this operation, impregnated down to a depth which lies about one millimeter or a few millimeters below the root of the protuberance 14 or the bottom surface of the grooves 12 and 13. In FIG. 1 is indicated by 16 the boundary line to which the impregnation penetrates in accordance with the preferred embodiment of the invention.

The impregnation liquid is an adhesive applied in liquid form, which has after hardening a certain flexibility. After hardening the impregnation liquid increases the rigidity of the protuberances 14 and prevents tearing. The adhesive does not fill the openings to prevent absorption but coats the surfaces which are then rigidified when the adhesive hardens. The adhesive, thus, toughens or increases the strength of the foam material at surface 11 without substantially impairing its flexibility or absorptivity. For this purpose synthetic adhesives are quite satisfactory. One adhesive used in practice is a polyurethane two-component adhesive. A particularly appropriate adhesive of this kind has the following composition:

- Polyol component (largely linear polyester-polyurethane with functional residual groups, approximately 0.1% hydroxyl groups; for instance available under the tradename Elastostik sold by BASF or under the tradename Desmocoll 176 sold by Bayer Leverkusen) — about 10–12%
- Plasticizer, preferably benzyl-butylphthalate (for instance available under the tradename Unimoll BB) — about 1.0–1.2%
- Polyisocyanate component, preferably Polyol-polyurethane-isocyanate of tolylene-diisocyanate with isocyanate residual groups — about 1.0–1.2%
- Solvent, preferably consisting of 88 parts ethyl-acetate and 12 parts acetone — about 87.6–88%

The aforementioned numerical data refer to percent by weight. They may vary within limits of about 10%.

After the impregnating operation and after the adhesive or impregnating liquid has at least partially hardened, a further operation step may be performed, such as coating of the projections 14 with abrasive material. For this purpose, adhesives can be used which correspond to the adhesives used for the impregnation. To these adhesives is admixed the fine-grained abrasive material, preferably in such a quantity that after the hardening of the adhesive its content of abrasive material amounts to about 10 to 20% by weight. As mentioned, a fine-granular foam material is preferably used as an abrasive. The material is produced by fragmentation of a rigid foam material, for instance polyurethane. The fine-grained rigid foam material is preferably added in a granular size of 100 to 200 $\mu$. It is mixed with the mentioned adhesive and applied to the upper surfaces of the protuberances 14 by means of a coating roller. This surface coating of the protuberances 14 is indicated in FIG. 1 at 15, where the rigid foam particles embedded in the adhesive are shown as fine points.

It is advisable to preform the impregnation and the aforementioned surface coating on the foam material strip or sheet 23 which is then cut into individual foam sponges 10 of the intended utility size and shape. With this procedure, warping and buckling of the foam material body by reason of the impregnating operation is reduced and generally eliminated.

As mentioned, the foam-material body according to the invention is used for cleansing, scrubbing, polishing and similar purposes. It can to great advantage be used in housekeeping chores, for instance as a rinsing or scouring sponge or else for the treatment of delicate lacquer, plastic or ceramic surfaces and the like. The sponge can also be used for taking care of motor vehicles, for instance for the cleaning of car windows, of painted surfaces of the motor vehicle and other parts thereof.

The impregnation liquid hardens to add strength to protuberances 14 which absorb the liquid in a sponge action found in foamed pads. The liquid then hardens to cause the desired strengthening action. The sponge or foamed plastic is compounded to be soft and pliable, as is common in household cleaning or scouring pads. Rigidity can be compounded into the foamed plastic material by well known compounding procedures.

Thus the hardness can be changed for producing a gentle abrasive material. The adhesive strengthens the foam material without causing loss of the sponge action.

Having thus defined the invention, the following is claimed:

1. A method of increasing the tear resistance of a foam plastic scouring, cleaning or polishing pad in the vicinity of a plurality of separate, closely adjacent foam plastic protuberances formed integrally with the body of the pad and defined by grooves in said pad, said pad being formed from a pliable, flexible open celled foamed plastic material with a low tear strength and said protuberances together forming an upper scrubbing surface and having a lower root portion terminating at a main portion of said body, said method comprising the steps of:

(a) providing a polyurethane liquid adhesive impregnating agent which will cure into a substantially elastic flexible mass and increase the tear strength of said foamed plastic material;

(b) impregnating said foam plastic protuberances, and part of said main body portion beyond said root portions, with amounts of said impregnating agent, so that said protuberances and said part of said main body portion will still be absorptive; and (c) causing said agent to cure whereby said protuberances and said part of said main body portion still are absorptive and are substantially more resistant to tearing than said initial foam plastic material.

2. A method as defined in claim 1 including the step of applying a particulate abrasive material onto said scrubbing surface after said impregnating step and before said impregnating agent has cured.

3. A method as defined in claim 1 including the additional steps of:

(d) compressing said pad body transversely of said scrubbing surface against the elasticity of said foam material and prior to said impregnating step; and (e) allowing said pad body to elastically release said compression after said impregnation step and before said impregnating agent cures.

4. A method as defined in claim 3 wherein said compressing step includes the step of: passing said pad between two rotating compression rolls.

5. A method as defined in claim 1 including the additional step of:

(d) separating said pad into smaller sections each including a plurality of said protuberances.

6. A method as defined in claim 1 wherein said impregnating agent is an adhesive based upon a polyol, and wherein polyol-polyurethane-isocyanate is used with a plasticizer and a solvent.

7. A method as defined in claim 1 wherein said impregnating agent is an adhesive including polyol, polyisocyanate, a plasticizer and a solvent.

8. A method as defined in claim 1 wherein said impregnating agent is an adhesive having approximately the following composition: 10%–25% polyol, 1.0%–1.2% polyol-polyurethane-isocyanate of tolylene-diisocyanate with isocyanate residual groups, 1.0%–1.2% plasticizer and 87.6%–88% solvent.

* * * * *